US006652314B2

(12) United States Patent
Tournadre

(10) Patent No.: US 6,652,314 B2
(45) Date of Patent: Nov. 25, 2003

(54) COMPONENTS FOR A COMPUTER SUB-ASSEMBLY

(75) Inventor: Vincent Tournadre, Meylan (FR)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 09/993,577

(22) Filed: Nov. 5, 2001

(65) Prior Publication Data

US 2003/0032328 A1 Feb. 13, 2003

(30) Foreign Application Priority Data

Aug. 13, 2001 (EP) ..... 01410101

(51) Int. Cl.[7] ..... H01R 13/60

(52) U.S. Cl. ..... 439/536

(58) Field of Search ..... 439/536, 608, 439/609, 271, 272, 273, 278; 174/35 R

(56) References Cited

U.S. PATENT DOCUMENTS 5,015,802 A * 5/1991 Chi ..... 174/35 R
5,139,427 A * 8/1992 Boyd et al. ..... 439/66

* cited by examiner

*Primary Examiner*—Jean F. Duverne

(57) ABSTRACT

A support member for a computer sub-assembly having a contact element, the contact element having an operative position in which electrical contact is made between the sub-assembly and the support member, characterized in that the contact element, in use, is biased resiliently towards the operative position.

34 Claims, 5 Drawing Sheets

COMPONENTS FOR A COMPUTER SUB-ASSEMBLY

DESCRIPTION OF AND BACKGROUND TO THE INVENTION

This invention relates to a support member for a computer sub-assembly, to a contact element for use with a computer sub-assembly support member and to a combination of a computer sub-assembly and a support member therefor.

In particular, although by no means exclusively, the invention relates to the field of computer drive units such as hard disk drives (HDD's), and the various components and assemblies that are used to secure such drive units in position within a computer chassis.

Typically, drive units such as HDD's are secured within a housing such as a drive cage, which itself is connected to—and in electrical contact with—the primary chassis of the computer. The cage is attached somewhat rigidly to the computer chassis, although the drive unit itself is often moveable within the cage so as to facilitate removal such as may be required for maintenance and repair purposes, for example. To facilitate removal and insertion of drive units in this way, support members such as drive unit trays or rails are employed, which are fixed to the drive unit but which are slideable within channels or tracks provided as part of the drive unit cage. An important characteristic of such support members is that they should provide a degree of protection for the drive unit concerned, but it is also important that an electrical path is established between the drive unit itself and the computer chassis, to allow the electrical and electronic components of the drive unit to be connected to earth via the computer's earthing facility.

As will be well understood by those skilled in the relevant art, such earthing is required not only from an electrical safety point of view, but also to reduce the effects of electromagnetic interference (EMI) which can be caused by—and have an impact on—the various internal components of a computer drive unit.

Hitherto, this electrical contact has been made by the use of threaded fasteners passing through a wall of the support member, and entering into suitably configured threaded recesses provided in external faces of the drive unit concerned. To ensure that good electrical contact is made, electrically conducting washers are often disposed between the head of the threaded fastener and the body of the support member, but these components are small, difficult to manufacture and highly susceptible to loss or damage.

It is an object of the present invention to provide a support member for a computer sub-assembly that reduces or overcomes this and other disadvantages and to provide an improved contact element for use with such a support member. It is also an object of the present invention to provide, in combination, an improved computer sub-assembly and a support member therefor.

In accordance with a first aspect of the present invention, there is provided a support member for a computer sub-assembly having a contact element, the contact element having all operative position in which electrical contact is made between the sub-assembly and the support member, characterised in that the contact element, in use, is biasec resiliently towards the operative position.

The contact element may comprise a protrusion acapted to co-operate with a recess associated with the sub-assembly.

Preferably, the protrusion comprises a protuberance such as a bump.

The contact element preferably is spring-biased towards the operative position.

Conveniently, the contact element is biased towards the operative position by a leaf spring, with the contact element conveniently comprising a protuberance formed from the material of the leaf spring.

The protuberance may be formed by way of a deformation operation such as pressing.

The contact element may be positioned in relation to the support member so as to aid and/or maintain correct location of the sub-assembly with the support member. The contact element may be positioned so as to aid tactile location of the sub-assembly with the support member.

Preferably, the support member comprises a HDD tray, the contact element conveniently being adapted to co-operate with a recess provided in a surface of a HDD.

The support member may be provided with a shock absorber operative to reduce the effect of any shock or vibration to which the support member is subjected, prior to it being transmitted to a computer sub-assembly supported thereby.

The shock absorber may have a bearing part biased resiliently towards the sub-assembly so as to maintain the sub-assembly in position in relation to the support member.

Preferably, the support member is provided by a leaf spring.

It will be appreciated from the foregoing that the invention, in its first aspect, provides a support member that, on the one hand, enables a good electrical connection to be effected between the support member and the subassembly in a particularly convenient and user-friendly manner, and which, on the other hand, provides resilient support for the sub-assembly which is effective, in use, to protect the sub-assembly against damage.

In accordance with a second aspect of the present invention, there is provided a contact element for use with a computer sub-assembly support member, the contact element having an operative position in which electrical contact is made between the sub-assembly and the support member, characterised in that the contact element, in use, is biased resiliently towards the operative position.

The contact element may form part of a contact assembly having an attachment element whereby the contact assembly may be secured to the support member.

The contact assembly preferably is generally resilient, securement of the contact assembly to the support member involving resilient deformation thereof.

The contact assembly may be formed from sheet material, the contact element conveniently being integral therewith.

The attachment element may comprise a projection extending away from the sheet material, the projection being co-operable with a recess or aperture provided in the support member.

The contact assembly may be provided with a shock absorber operative to reduce the effect of any shock or vibration to which the support member is subjected, prior to it being transmitted to a computer sub-assembly supported thereby.

The shock absorber may be provided by a leaf spring

From the foregoing, it will also thus be appreciated that the invention, in its second aspect, provides a device which, in use, may be attached to an existing drive unit tray or rail, to provide the tray or rail with the advantages of the more unitary construction described in relation to the first aspect of the present invention. By manufacturing the contact element from sheet (e.g. sheet metal) material, an inherent degree of resilience is imparted thereto, which not only facilitates attachment of the contact assembly to the support member, but also provides the shock absorber and contact element with their resilient characteristics.

In accordance with a third aspect of the present invention, there is provided, in combination, a computer sub-assembly and a support member therefor, the support member having a contact element which, in an operative position, allows electrical contact to be made between the sub-assembly and the support member whereby the sub-assembly may be earthed, the contact element, in use, being biased resiliently towards the operative position and being configured so as to be co-operable with a receiving formation provided in or on the computer sub-assembly.

The sub-assembly may be a drive unit and the support member may comprise a drive unit tray or rail.

In accordance with a fourth aspect of the present invention, there is provided a support member for a computer drive unit having a contact element, the contact element having an operative position in which electrical contact is made between the drive unit and the support member, characterised in that the contact element, in use, is biased resiliently towards the operative position, and in that the contact element comprises a protrusion such as a bump which is co-operable with an electrically conductive aperture or recess provided in a surface of the drive unit.

In accordance with a fifth aspect of the present invention, there is provided a contact element for use with a computer drive unit support member such as a tray or rail, the contact element having an operative position in which electrical contact is made between the drive unit and the support member, the contact element, in use, being biased resiliently towards the operative position, and wherein the contact element comprises a protrusion such as a bump which, in use, is engageable within an electrically conductive aperture or recess provided in a surface of the drive unit.

BRIEF DESCRIPTION OF THE DRAWINGS

The invention, in its various aspects, will now be described in greater detail, but strictly by way of example only, by reference to the accompanying drawings, of which.

DETAILED DESCRIPTION OF THE DRAWINGS AND BEST MODE OF THE INVENTION

Figure 1:
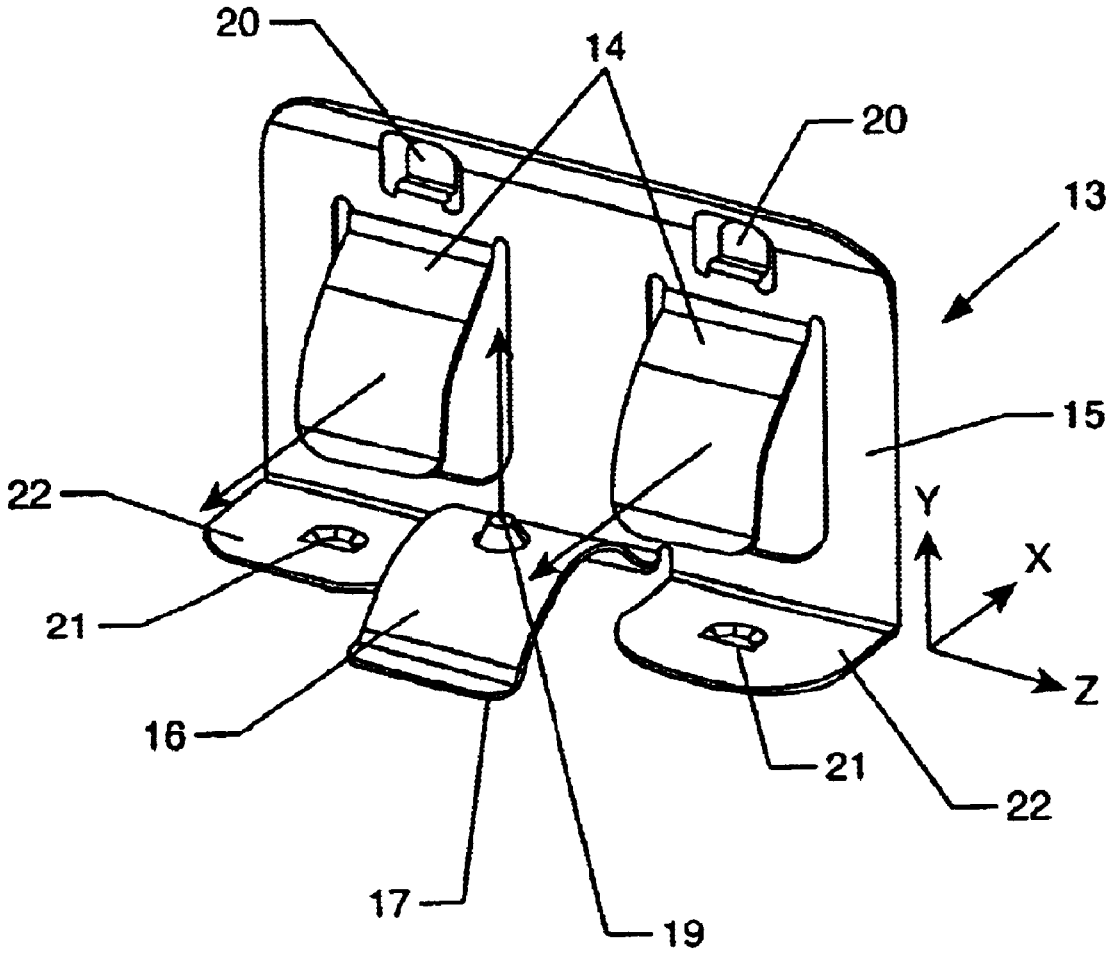
FIG. 1 is a perspective view of a contact assembly.
Figure 2:
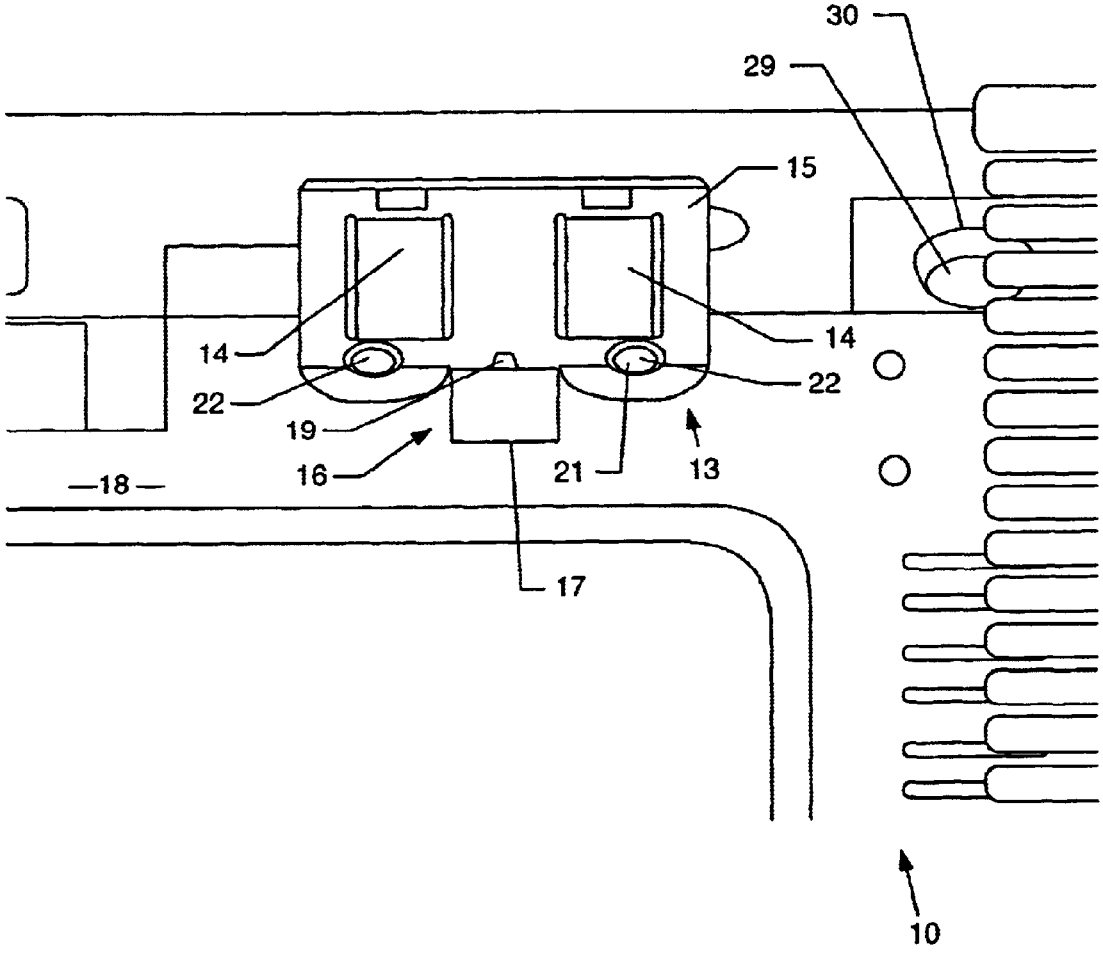
FIG. 2 is a view from above of the contact assembly of FIG. 1, shown attached to a drive unit tray.
Figure 3:
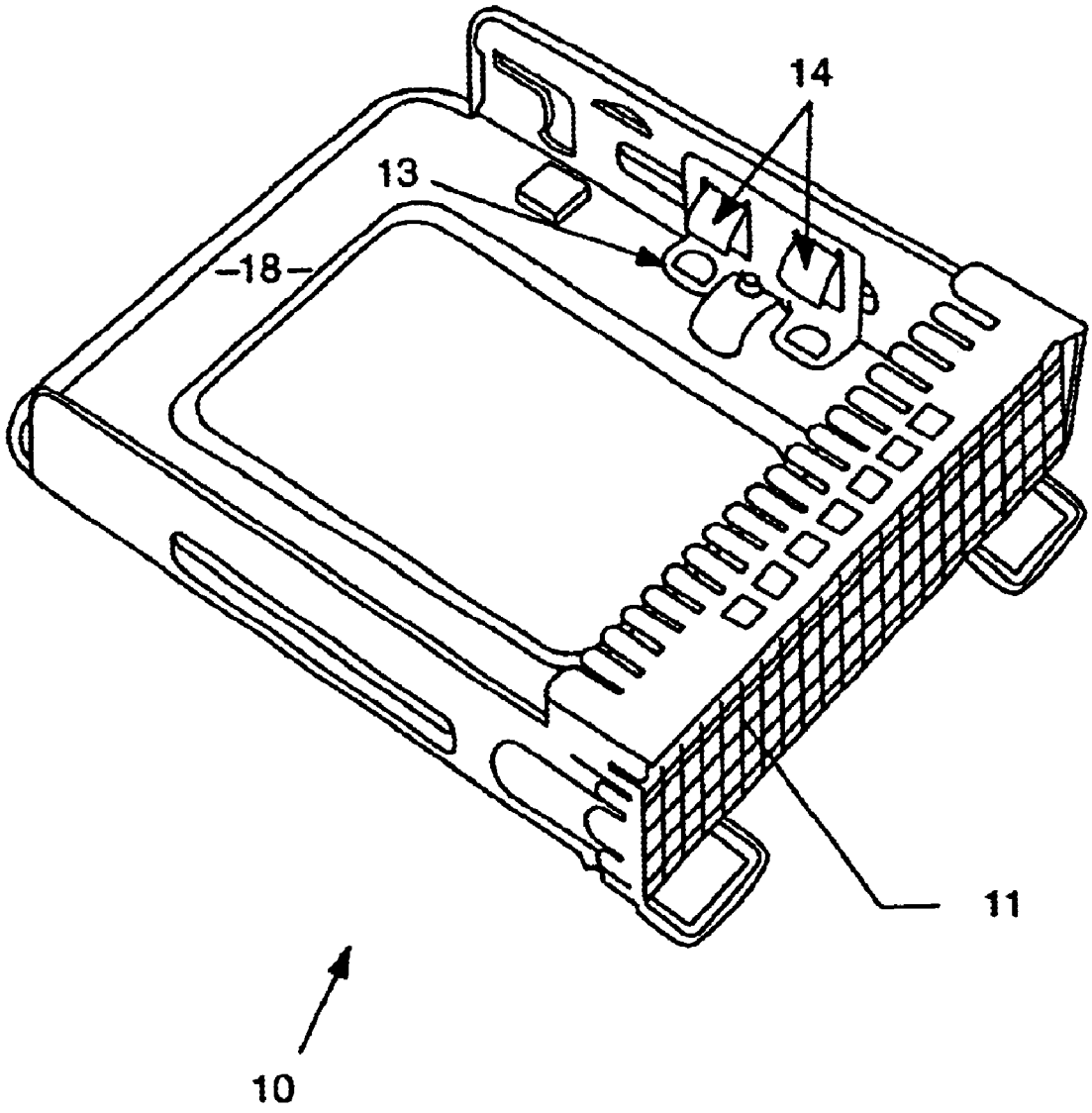
FIG. 3 is a perspective view, from above, of the, tray and contact assembly of FIG. 2.
Figure 4:
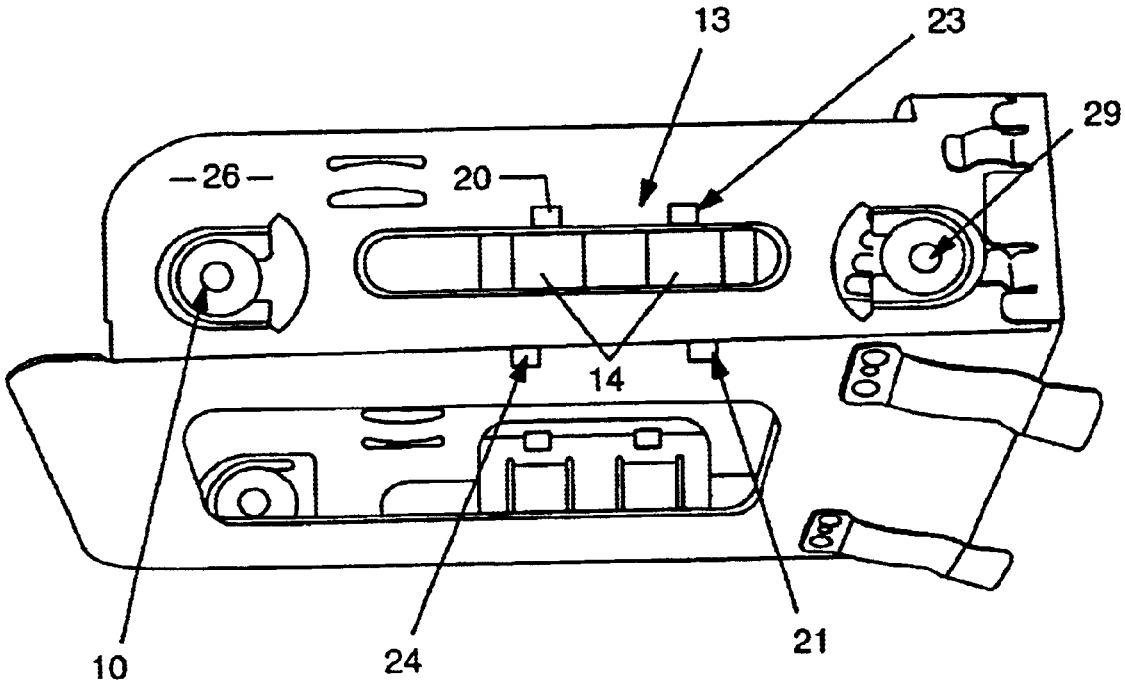
FIG. 4 is a side perspective view of the tray and contact assembly of FIGS. 2 and 3.
Figure 5:
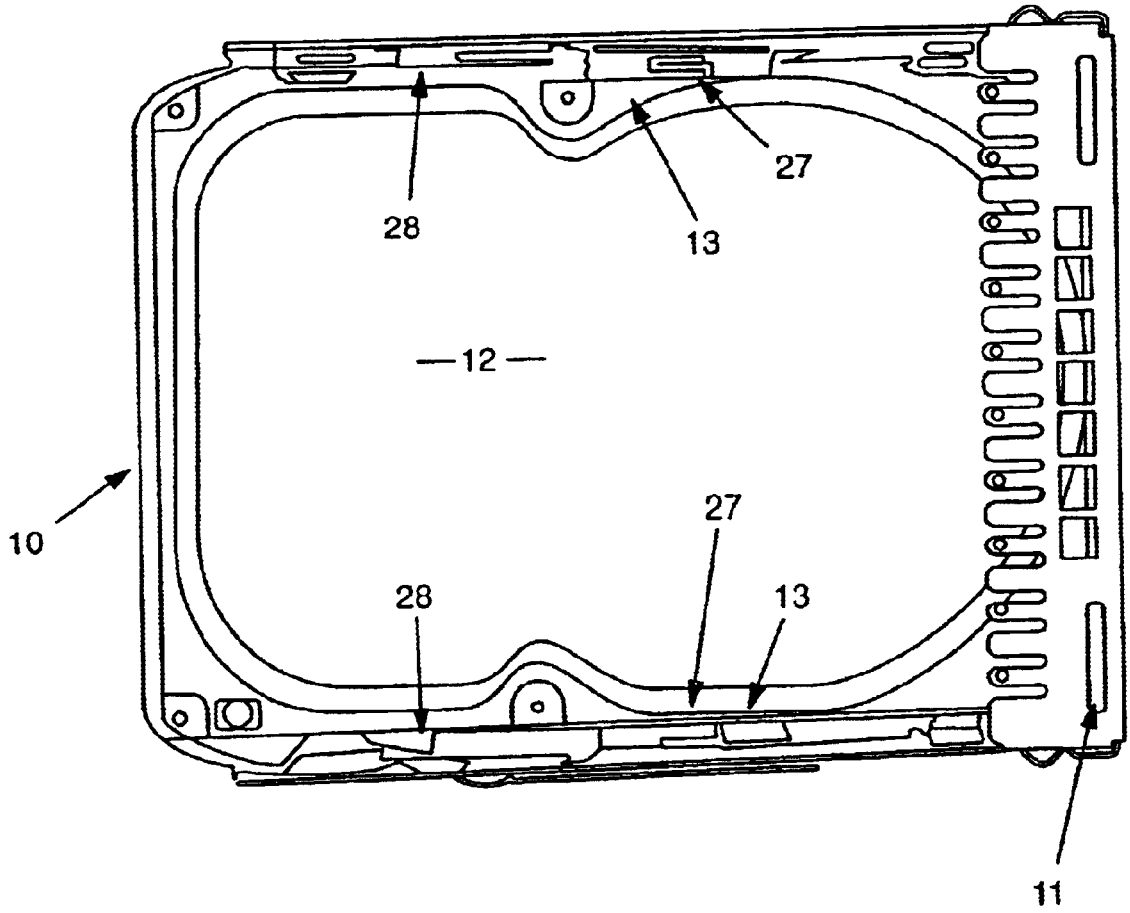
FIG. 5 is a plan view of the tray and contact assembly of FIGS. 2, 3 and 4, shown with a hard disk drive in position.

Referring to the Figures, a hard disk drive (HDD) tray 10 is shown which, in generally conventional manner, has a somewhat open box-like configuration. The tray 10 is provided with an end grille 11 which, as shown in FIG. 5, acts as a stop when a hard disk drive (HDD) 12 is located in the tray. In accordance with the invention, the tray 10 is provided with opposing contact assemblies 13, each of which comprises a pair of leaf springs 14 which extend away from a rear wall 15 of the contact assembly in a resiliently biased manner. The contact assemblies 13 are also provided with a generally horizontally orientated leaf spring 16 having a distal foot 17 which, when the assembly 13 is attached to the tray 10, bears upon the tray's floor 18. The bent configuration of the leaf spring 16 (which may be generally curved, as shown in FIG. 1, or may have a somewhat folded configuration, as shown in FIGS. 2 and 3) provides the spring 16 with a degree of resilience which is effective to resist downward deformation thereof, for the purpose described hereafter.

The leaf spring 16 has formed therein a raised protrusion 19 such as a bump which, like the rest of the contact assembly 13, is formed from an electrically conductive material such as sheet metal.

The contact assemblies 13 are attached to the tray 10 using a number of attachment elements such as tabs 20, which extend rearwardly and upwardly of the assembly wall 15, and downwardly extending protrusions 21 formed in the horizontally extending feet 22 of the assembly 13.

The tabs 20 and protrusions 21 are configured and positioned so as to be locatable within apertures 23 and 24 provided in the side wall 26 and floor 18 respectively of the tray 10, with the resilience afforded by the assembly 13 allowing the assembly to be engaged with the tray in a somewhat catch-like manner.

In an alternative embodiment, the contact assembly 13 may be formed integrally with the tray.

In use, the leaf springs 14 and 16, in conjunction with the bump-like protrusion 19, serve to assist in locating the HDD 12 in a correct position in the tray 10. As will be understood by those well versed in the relevant art, standard 3.5" HDD's are provided on their underside with a number (usually four) of threaded apertures, at the positions shown by the arrows 27 and 28 in FIG. 5. It will thus be appreciated, from FIGS. 2 and 5 especially, that, as the HDD 12 is introduced into the tray 10 by a manufacturer or user, the upwardly biased protrusion 19 will enter into the downwardly facing aperture of the HDD at the position 27 shown in FIG. 5, thus assisting the manufacturer/user to locate the HDD correctly in a tactile (touch-based) manner. More importantly, introduction of the electrically conductive protrusion 19 into the internal threaded aperture of the HDD 12 effects an electrical connection between the contact assembly 13 and the HDD, and thus between the HDD and the tray 10 and, in consequence, to the chassis and earth connection of the associated computer. This electrical connection is important to reduce any unwanted and potentially dangerous/damaging EMI effects, and to ensure, from a safety viewpoint, that the internal electrical and electronic components of the HDD 12 are connected to earth via the computer's principal earthing connection.

To secure the HDD in position in the tray, four threaded fasteners are introduced through appropriate attachment points 29, each of which has associated therewith a non-electrical conductive grommet 30 which is effective to reduce the effects of any external shock or vibration from the HDD 12.

However, as a result of the electrical contact made directly between the HDD 12 and the protrusion 19, the use of electrically conductive washers in conjunction with the grommets 30 is obviated, thus removing, from the construction, a small and inconvenient component which, hitherto, has been found to be highly susceptible to loss or damage.

It will also be appreciated that the interaction of the protrusion 19 and the associated threaded recess of the HDD 12 is effective to restrain the HDD 12 from unwarranted and inadvertent sliding movement in the Z-axis, as shown in FIG. 1. Similarly, the resilience of the leaf spring 16 prevents unwanted movement of the HDD 12 in the Y-direction, whilst at the same time providing a cushioning facility in the event that the tray or cage is subjected to any potentially damaging mechanical shock or vibration.

In the X-direction (see FIG. 1) unwanted movement is prevented by the inwardly urged leaf springs 14 which, as can be seen in FIG. 5, press against the side walls of the HDD 12 thus maintaining it securely in position.

In the present specification "comprises" means "includes or consists of" and "comprising" means "including or consisting of".

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

What is claimed is:

1. A support member for a computer sub-assembly having a contact element, the contact element having an operative position in which electrical contact is made between the sub-assembly and the support member, characterised in that the contact element, in use, is biased resiliently towards the operative position, and that the computer sub-assembly is a drive unit that is supported from beneath by the support member.

2. A support member according to claim 1 wherein the contact element comprises a protrusion adapted to co-operate with a recess associated with the sub-assembly.

3. A support member according to claim 1 wherein the contact element comprises a protuberance such as a bump.

4. A support member according to claim 1 wherein the contact element is spring-biased towards the operative position.

5. A support member according to claim 1 wherein the contact element is biased resiliently towards the operative position by a leaf spring, and wherein the contact elements comprises a protuberance formed from the material of the leaf spring.

6. A support member according to claim 5 wherein the protuberance is formed by way of a deformation operation such as pressing.

7. A support member according to claim 1 wherein the contact element is positioned in relation to the support member so as to aid and/or maintain correct location of the sub-assembly with the support member.

8. A support member according to claim 7 wherein the contact element is positioned in relation to the support member so as to aid tactile location of the sub-assembly with the support member.

9. A support member according to claim 1 comprising a HDD tray, wherein the contact element is adapted to co-operate with a recess provided in a surface of a HDD.

10. A support member according to claim 1 having a shock absorber operative to reduce the effect of any shock or vibration to which the support member is subjected, prior to it being transmitted to a computer sub-assembly supported thereby.

11. A support member according to claim 10 wherein the shock absorber has a bearing part biased resiliently towards the sub-assembly so as to maintain the sub-assembly in position in relation to the support member.

12. A support member according to claim 10 wherein the shock absorber is provided by a leaf spring.

13. A contact element for use with a computer sub-assembly support member, the contact element having an operative position in which electrical contact is made between the sub-assembly and the support member, characterised in that the contact element, in use, is biased resiliently towards the operative position, and that a computer drive unit is supported from beneath by the support member.

14. A contact element according to claim 13 forming part of a contact assembly having an attachment element whereby the contact assembly may be secured to the support member.

15. A contact element according to claim 13 wherein the contact assembly is generally resilient, securement of the contact assembly to the support member involving resilient deformation thereof.

16. A contact element according to claim 14 wherein the contact assembly is formed from sheet material, the contact element being integral therewith.

17. A contact element according to claim 16 further comprising an attachment element comprising a projection extending away from the sheet material, the projection being co-operable with a recess or aperture provided in the support member.

18. A contact element according to claim 14 wherein the contact assembly is provided with a shock absorber operative to reduce the effect of any shock or vibration to which the support member is subjected, prior to it being transmitted to a computer sub-assembly supported thereby.

19. A contact element according to claim 18 wherein the shock absorber is provided by a leaf spring.

20. In combination, a computer sub-assembly and a support member therefor, the support member having a contact element which, in an operative position, allows electrical contact to be made between the sub-assembly and the support member whereby the sub-assembly may be earthed, the contact element, in use, being biased resiliently towards the operative position and being configured so as to be co-operable with a receiving formation provided in or on the computer sub-assembly, wherein the computer sub-assembly is a drive unit that is supported from beneath by the support member.

21. The combination of claim 20 wherein the sub-assembly is a drive unit and the support member is a drive unit tray or rail.

22. A support member for a computer drive unit having a contact element, the contact element having an operative position in which electrical contact is made between the drive unit and the support member, characterised in that the contact element, in use, is biased resiliently towards the operative position, and in that the contact element comprises a protrusion such as a bump which is co-operable with an electrically conductive aperture or recess provided in a surface of the drive unit.

23. A contact element for use with a computer drive unit support member such as a tray or rail, the contact element having an operative position in which electrical contact is made between the drive unit and the support member, the contact element, in use, being biased resiliently towards the operative position, and wherein the contact element comprises a protrusion such as a bump which, in use, is engageable within an electrically conductive aperture or recess provided in a surface of the drive unit.

24. A support means for a computer sub-assembly, said support means comprising a contact element, the contact element corresponding to a resilient tab extending from the support means and adapted so that the computer sub-assembly is positioned and supported from beneath in a mounting position while maintaining electrical contact between the sub-assembly and the support means.

25. A support means according to claim 24 wherein the sub-assembly is positioned in relation to the support means by means of a protrusion formed in the contact element and adapted to cooperate with a corresponding recess in the sub-assembly.

26. A support means according to claim 24 wherein the contact element is spring-biased towards the mounting position.

27. A support means according to claim 24 wherein the contact element is in the form of a leaf spring.

28. A support means according to claim 25 wherein the protrusion is formed by deforming a portion of the contact element.

29. A support means according to claim 27 wherein the leaf spring is in the form of a curved spring portion, said spring attached to the support means at a proximal end of the spring portion and having a foot at a distal end of the spring portion, wherein in the mounting position, the leaf spring is adapted to support the sub-assembly and, where the contact element is mounted above a proximate surface, said foot is adapted to bear against said surface when the contact element is subjected to the weight of the sub-assembly in the mounting position.

30. A support means according to claim 24 further comprising one or more resilient members oriented and adapted to cushion shocks applied to the sub-assembly in directions generally towards the support means.

31. A support means according to claim 30 wherein the resilient members correspond to one or more leaf springs protruding from the support means.

32. A support means according to claim 24 wherein the support means is constructed as a separate device and is adapted to be mounted on an associated computer chassis structure.

33. A support means according to claim 24 wherein the support means is formed integrally with an associated computer chassis structure.

34. A support means according to claim 24 wherein the support means is adapted to be mounted on a hard-disk drive tray, wherein the contact element is adapted to engage with a recess formed in a casing of a hard-disk thereby aiding in positioning the hard-disk in a support position while maintaining electrical contact between the hard-disk and the hard-disk drive tray.

* * * * *